US006244729B1

(12) United States Patent
Waldmann

(10) Patent No.: US 6,244,729 B1
(45) Date of Patent: Jun. 12, 2001

(54) LAMP ASSEMBLY WITH ADJUSTABLE REFLECTOR

(75) Inventor: Gerhard Waldmann, Dauchingen (DE)

(73) Assignee: Herbert Waldmann GmbH & Co. (DE)

( * ) Notice: Subject to any disclaimer, the term of this patent is extended or adjusted under 35 U.S.C. 154(b) by 0 days.

(21) Appl. No.: 09/313,595

(22) Filed: May 18, 1999

(30) Foreign Application Priority Data

May 20, 1998 (DE) ..... 198 22 580

(51) Int. Cl.[7] ..... F21V 21/14

(52) U.S. Cl. ..... 362/260; 362/217; 362/282; 362/284; 362/322; 362/324

(58) Field of Search ..... 362/277, 280, 362/282, 283, 284, 319, 322, 324, 217, 260

(56) References Cited

U.S. PATENT DOCUMENTS 4,872,098 * 10/1989 Romano ..... 362/284
5,855,427 * 1/1999 Lassovsky ..... 362/283
6,059,435 * 5/2000 Hamm et al. ..... 362/284

FOREIGN PATENT DOCUMENTS 7203765 12/1972 (DE) .
2417605 10/1974 (DE) .

* cited by examiner

*Primary Examiner*—Thomas M. Sember
(74) *Attorney, Agent, or Firm*—Eugene E. Renz, Jr., PC

(57) ABSTRACT

A lamp assembly comprising at least one elongated fluorescent tube and an elongated reflector of trough-like shape having a longitudinal center plane coincident with the longitudinal axis of the fluorescent tube. The shape of the reflector (10) is variable. Adjusting devices (34, 36) at least at one end of the reflector (10) changes the position of the free longitudinal edges (32) of the reflector (10), which forces the shape of the reflector (10) to change also.

12 Claims, 3 Drawing Sheets

LAMP ASSEMBLY WITH ADJUSTABLE REFLECTOR

FIELD OF THE INVENTION

The present invention relates to improvements in lamp assemblies.

BACKGROUND OF THE INVENTION

Various lamps with adjustable reflectors are known, in which rigid parts of the reflectors are supported so that they can pivot around their longitudinal axis with respect to the fluorescent tube. As a result, it is possible to deflect the beam characteristic of the reflector part in question as a whole in different directions, that is, upward, to the side, or downward. With the known devices, however, it is not possible with the known reflector to vary the beam characteristic over a wide range, such as between a wide-beam and a narrow-beam characteristic, or to give it an asymmetric characteristic.

SUMMARY OF THE INVENTION

It is therefore an object of the present invention to improve lamps of the general type indicated above in such a way that the beam characteristic of the reflector can be varied in a predetermined pattern. To this end, in accordance with the present invention, the lamp comprises at least one long fluorescent tube and an elongated reflector of trough-like shape having a variable shape and including an adjusting device for selectively changing the position of the free longitudinal edges of the reflector which change forces a change in the shape of the reflector.

The shape of the reflector can be changed either by bending it or by dividing it into several lengthwise strips hinged together and by adjusting the angle of the strips with respect to each other. Thus, it is very easy to change the beam characteristic over a wide range. The adjusting devices for shifting the longitudinal edges of the reflector can be very easily designed to operate mechanically, electrically, or in some other way. In the case of elastically flexible reflectors, it is necessary in all cases to adjust both ends of the longitudinal edges to ensure that the curvature of the reflector in question is uniform over its entire length.

Advantageous embodiments and features of the present invention including various mechanical and/or motorized adjusting device, designs and reflector design described in more detail hereafter.

BRIEF DESCRIPTION OF THE DRAWINGS

These and other objects of the present invention and various features and details of the operation and construction thereof are hereinafter more fully set forth with reference to the accompanying drawings, wherein.

DESCRIPTION OF THE EMBODIMENT

Figure 1:
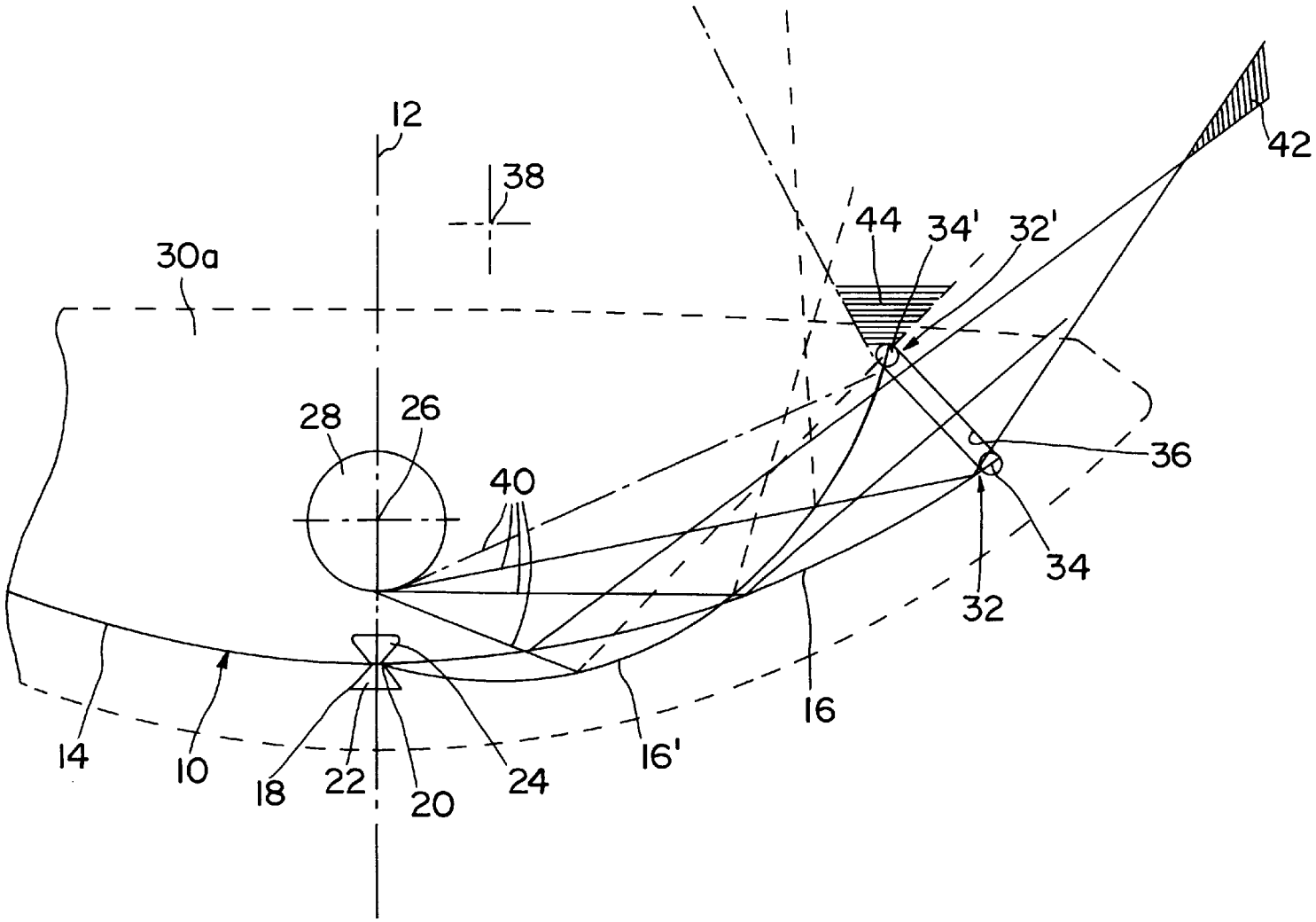
FIG. 1 shows a schematic diagram of a partial cross section through a first embodiment of the lamp according to the invention, perpendicular to the longitudinal center plane of the lamp.

Referring now to the drawings and particularly to FIG. 1, thereof, there is sown an improved lamp assembly in accordance with the present invention. The lamp assembly comprises an opaque, mirror-finish reflector 10, designated overall by the number 10, consisting of two reflector halves 14, 16, which are symmetric to a longitudinal center plane 12—12 of the lamp and which, in profile, have a circular curvature C. Edges 18, 20 of the two reflector halves 14, 16 at center plane 12—12 are loosely held in pivoting fashion between approximately wedge-shaped, partially interlocking retaining elements 22, 24. The two retaining elements 22, 24 are parallel to center plane 12—12 and extend over the entire length of the lamp. Longitudinal axis 26 of a fluorescent tube 28 installed above retaining elements 22, 24 coincides with center plane 12—12. Reflector 10 and fluorescent tube 28 also extend essentially over the entire length of the lamp between two perpendicular end walls 30*a*, 30*b*, only one of which can be seen in FIG. 1, namely, end wall 30*a* situated behind the plane of the drawing. Both retaining elements 22, 24 and fluorescent tube 28 are rigidly attached to the end walls 30*a* and 30*b* (not shown).

In this embodiment, the two reflector halves 14, 16 consist of flexible material. A link block 34 is attached to each end of the free longitudinal edges 32 of the reflector halves near end walls 30. This block engages in and slides along a straight, upward- and inwardly-slanting link slot 36 in end wall 30*a*. Only the longitudinal edge of the right reflector half 16 can be seen in FIG. 1. When the link block is slid from lower position 34 at one end of link slot 36 to upper position 34' at the other end, the associated reflector half 16 is forcibly bent into a more highly curved position 16'. In the case of the embodiment shown here, the center point of the curvature of the more highly bent position 16' is approximately at point 38, whereas the center of curvature of the less curved position 16 would be far beyond the upper edge of the drawing. The link block has fastening devices (not shown), such as set screws or the like, to hold it in one of the end positions 34, 34' or possibly in a selected intermediate position somewhere along link slot 36. In the case of a different design (not shown), a motor is provided to move link block 34 along link slot 36.

Because, in this embodiment, the material of reflector 10 is elastically flexible, it is necessary, of course, to provide rear wall 30*a*situated above the plane of the drawing, which therefore cannot be seen in FIG. 1, with an adjusting device similar to that on rear end wall 30*a*, so that similar adjustments can be made at both ends. Thus each reflector half 14, 16 will have a uniform curvature all the way along.

Whereas the light being beamed upward from fluorescent tube 28 is usually unhindered, most of the light being beamed laterally and downward is reflected by reflector 10. Depending on the curvature of the reflector, this light exits at various angles in a more-or-less upward direction. For the right reflector half 16, several representative beam paths 40 of the light proceeding from fluorescent tube 28 to reflector half 16 are shown in FIG. 1. The beams reflected from the reflector half in its less curved position 16 are drawn in solid line, whereas the beams reflected from the reflector in its more highly curved position 16' are shown in broken line. In the case of less curved position 16', all of the reflected beams fall within an angle 42 indicated by shading, which is relatively narrow and which points laterally upward, whereas, in the case of more highly curved position 16', a much wider, essentially upward-directed, reflected-light region 44 is obtained, which can even be asymmetric to center plane 12—12 in some cases.

Because link slot 36 or some other type of adjusting device (not shown) can have any desired inclination, length, and shape and can be designed in almost any desired way, all of which can be easily realized by the expert, reflector 10 can be given many different positions and curvatures, it being assumed that similar adjusting devices are also provided at end wall 30 situated in front of the plane of the drawing and on the left halves of the two end walls 30*a*, 30*b*. The adjusting devices can be connected to each other by gears or synchronized by motorized drives, so that reflector 10 can be adjusted easily and precisely over a wide range. The reflector can be adjusted either at the factory or at the installation site to suit the concrete application.

Figure 2:
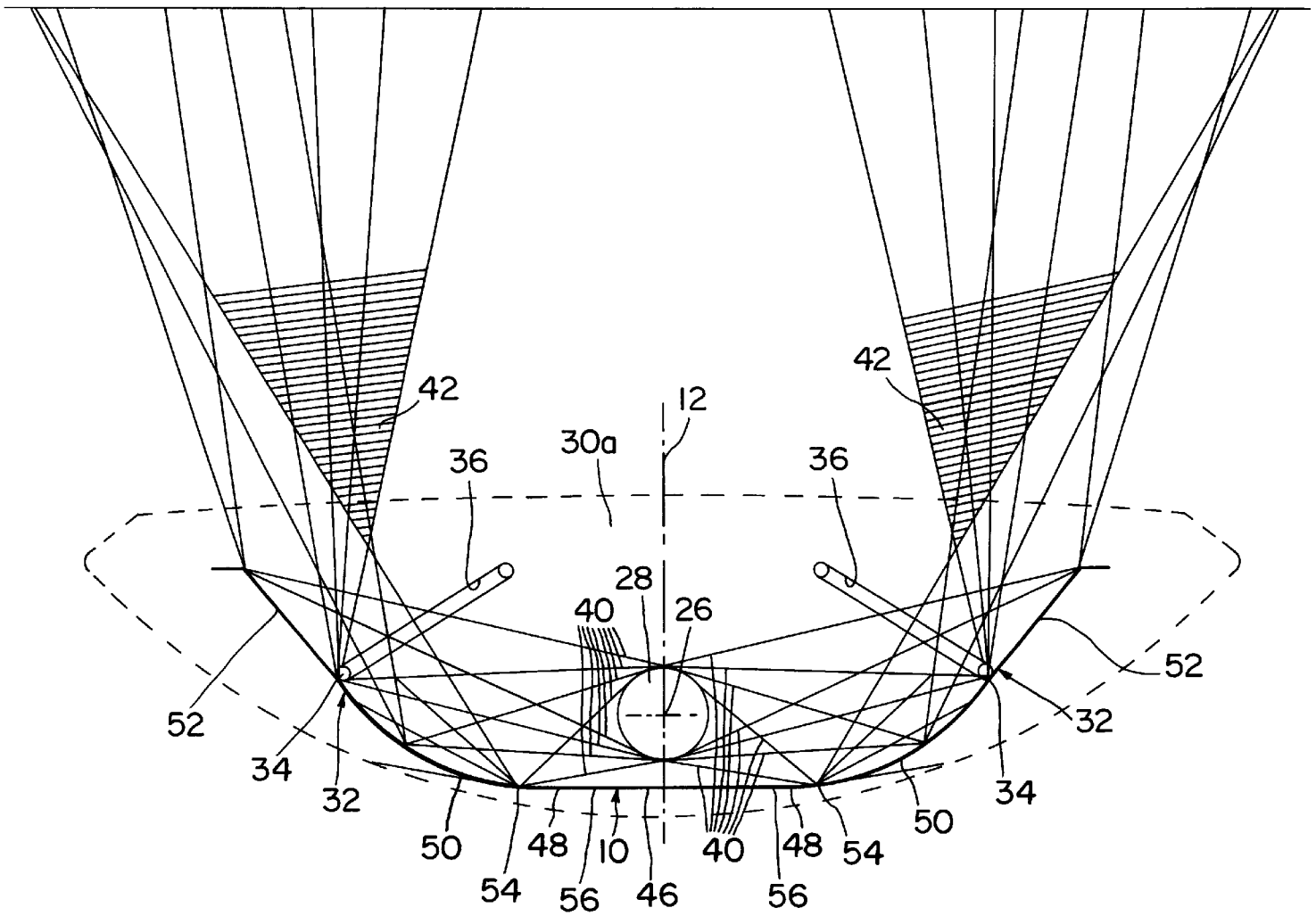
FIG. 2 shows a cross section similar to that of FIG. 1 through a second embodiment of the lamp according to the invention.
Figure 3:
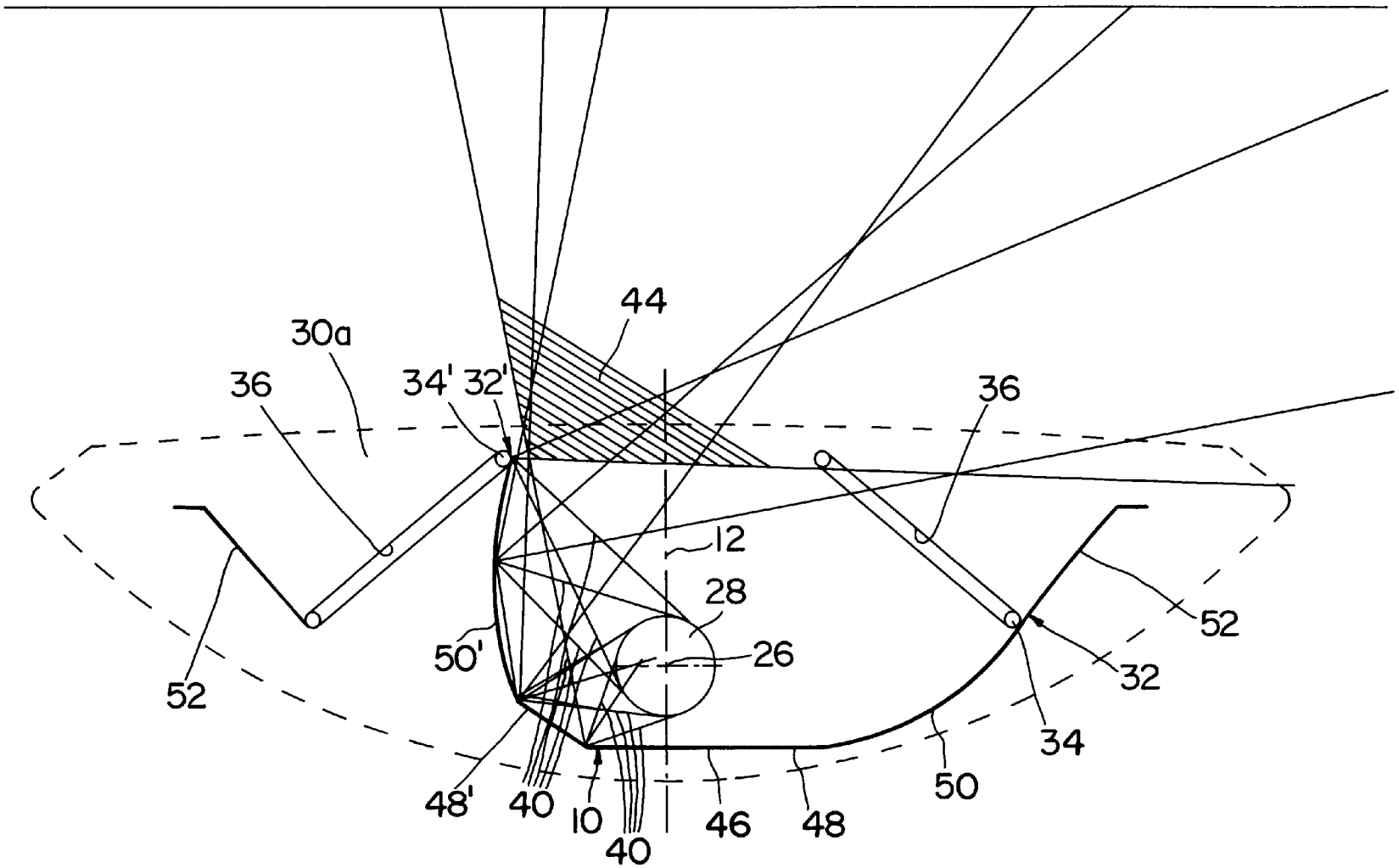
FIG. 3 shows a cross section similar to that of FIG. 2 through the second embodiment with a different type of reflector shape.

The embodiment shown in FIGS. 2 and 3 differs from that of FIG. 1 in that reflector 10 is made of rigid or less flexible material and is divided into several adjoining longitudinal strips 46, 48, 50, 52. Center strips 46, extending along both sides of center plane 12—12, and outermost longitudinal strips 52, extending along the sides of reflector 10, remain essentially stationary even during the adjustment of reflector 10. Between stationary longitudinal strips 46, 52, two movable longitudinal strips 48, 50 are arranged on both sides, with are connected not only to each other but also to the fixed middle strip 46 by hinge joints 54, 56.

At the free edge 32 of outer movable longitudinal strip 50, are link block 34 is attached, which can slide in a link slot 36 in end wall 30 to an upper end position 34' in the same way as in the embodiment according to FIG. 1. Again, by means of fastening devices (not shown) or motorized drives, it is possible to fix the strips in position in any desired intermediate point along link slot 36. If longitudinal strips 48, 50 are sufficiently stiff over the entire length of the lamp, it is possible in this embodiment to adjust free edge 32 at only one end near rear end wall 30. Because of the stiffness of the strips, the adjustment is transmitted all the way to forward end wall 30 situated in front of the plane of the drawing. In the extreme case, the for ward end of the strip at forward end wall 30 does not even have to be guided in an adjusting device but will rather simply follow at this end wall 30 the adjusting movement occurring at rear end wall 30.

In this embodiment, stationary outer longitudinal strips 52 of reflector 10 are not adjusted and thus do not contribute to the change of the beam characteristic of reflector 10. They serve only to prevent blinding light from being beamed out straight to the side or slightly upward.

FIG. 2 also shows several representative beam paths 40 of the light proceeding from fluorescent tube 28 on both sides of center plane 12—12. When reflector 10 is in the position according to FIG. 2, the beams reflected by reflector 10 fall on both sides of center plane 12—12 in shaded angular areas 42. It can be seen that, in addition to the unhindered upward passage of light from fluorescent tube 28, the light being beamed downward and to the side is reflected by reflector 10 so that it, too, proceeds essentially upward.

In the diagram of FIG. 3, the adjusting device on the left side of reflector 10 is moved by displacement of link block 34 to position 34'. As a result, movable longitudinal strips 48, 50 of reflector 10 have been pivoted into more steeply angled position 48', 50'. Whereas the beam characteristic of the right half of reflector 10 remains the same as it was in FIG. 2, the beam characteristic of the left half of reflector 10 according to FIG. 3 is now added to that of the right half. Because all of the beams reflected by the left half 48', 50' fall within an essentially expanded angle 44, what is obtained now is a highly asymmetric beam characteristic directed upward and to the right. If the right half of reflector 10 were now to be adjusted in the same way as the left half according to FIG. 3, a wide-beam light pattern extending down as far as the horizontal plane would be obtained, which differs significantly from the beam characteristic of FIG. 2. By using the adjusting device to select an intermediate position, it is possible to obtain any desired beam characteristic of the lamp ranging between narrow-beam and wide- beam and even including various types of asymmetric beam.

In this embodiment, too, it is possible for the desired adjustment of the reflector to be made either right in the factory or on site as needed. The factory needs to produce only a single lamp for a wide variety of applications, since the lamp can be adapted to the specific application in question by adjustment of the desired beam characteristic.

Even though particular embodiments of the present invention have been illustrated and described herein, it is not intended to limit the invention and changes and modifications may be made therein within the scope of the following claims for example.

What is claimed is:

1. In a lamp assembly comprising at least one elongated fluorescent tube having a longitudinal axis, an elongated reflector of trough-like shape having a longitudinal center plane coincident with the longitudinal axis of the fluorescent tube, the shape of said reflector (10) being variable, and adjusting devices (34, 36) at least at one end of the reflector (10) for changing the position of the free longitudinal edges (32) of the reflector (10), the change of position forcing the shape of the reflector (10) to change also; said reflector (10) being divided into a plurality of longitudinal strips (46, 48, 50), having adjoining edges of said strips being hinged to each other.

2. In a lamp assembly according to claim 1, characterized in that each end of the reflector (10) is held in a vertical end wall (30) of the lamp.

3. In a lamp assembly according to claim 1, including an adjusting device (34, 36) for each free longitudinal edge (32) of the reflector (10).

4. In a lamp assembly according to claim 1 wherein the adjusting device (34, 36) consists of a link block (36) located in an end wall (30), wherein the link block (34) is attached to the free longitudinal edge (32) of the reflector (10).

5. In a lamp assembly according to claim 1, wherein the adjusting devices (34, 36) can be fixed in any desired position.

6. In a lamp assembly according to claim 1, wherein two or more adjusting devices (34, 36) are connected by a set of gears or rods, which transmit the adjusting movement of an adjusting device to the other adjusting devices (34, 36).

7. In a lamp assembly according to claim 1, wherein each adjusting device has a motorized drive.

8. In a lamp assembly according to claim 7, wherein at least one adjusting device with motorized drive is assigned to each free longitudinal edge (32) of the reflector (10).

9. In a lamp assembly according to claim 8, wherein all the motorized drives are synchronized with each other.

10. In a lamp assembly according to claim 1, wherein reflector (10) is divided along said center plane (12—12) into two one-piece parts (14, 16), the edges (18, 20) of the two parts (14, 16) at the center plane (12—12) being mounted in such a way that they can pivot.

11. In a lamp assembly comprising at least one elongated fluorescent tube having a longitudinal axis, an elongated reflector of trough-like shape having and ends, said longitudinal edge, center plane coincident with the longitudinal axis of the fluorescent tube, the shape of said reflector (10) being variable, and adjusting devices (34, 36) at least at one end of the reflector (10) for changing the position of the free longitudinal edges (32) of the reflector (10), the change of position forcing the shape of the reflector (10) to change also; said reflector divided into several a longitudinal strips (46,48,50) having adjoining edges which are hinged together, said reflector (10) having an outer edge strip (52), which is not connected to the longitudinal edge (32) of the reflector (10) but is attached rigidly to the end walls (30).

12. In a lamp assembly comprising at least one elongated fluorescent tube having a longitudinal axis, an elongated reflector of trough-like shape made of an elastically deformable material having a longitudinal center plane coincident with the longitudinal axis of the fluorescent tube and adjusting devices (34, 36) for changing the position of the free longitudinal edges (32) of the reflector (10), the change of position elastically deforming the reflector (10) generally transversely to the longitudinal axis to thereby provide a variably shaped reflector.

* * * * *